US009919192B2

(12) United States Patent
Trzmiel

(10) Patent No.: US 9,919,192 B2
(45) Date of Patent: Mar. 20, 2018

(54) GOLF CLUB

(71) Applicant: Alfred Trzmiel, Nürtingen (DE)

(72) Inventor: Alfred Trzmiel, Nürtingen (DE)

( * ) Notice: Subject to any disclaimer, the term of this patent is extended or adjusted under 35 U.S.C. 154(b) by 0 days.

(21) Appl. No.: 15/145,892

(22) Filed: May 4, 2016

(65) Prior Publication Data

US 2016/0325160 A1 Nov. 10, 2016

(30) Foreign Application Priority Data

May 8, 2015 (DE) ..... 10 2015 006 155

(51) Int. Cl.

| | |
|---|---|
| ***A63B 53/14*** | (2015.01) |
| ***A63B 60/32*** | (2015.01) |
| ***A63B 69/36*** | (2006.01) |
| ***A63B 21/045*** | (2006.01) |
| ***A63B 21/16*** | (2006.01) |
| ***A63B 53/00*** | (2015.01) |
| ***A63B 21/00*** | (2006.01) |
| ***A63B 60/52*** | (2015.01) |
| ***A63B 60/20*** | (2015.01) |
| ***A63B 60/14*** | (2015.01) |
| *A63B 23/035* | (2006.01) |
| *A63B 23/12* | (2006.01) |
| *A63B 60/22* | (2015.01) |
| *A63B 60/54* | (2015.01) |

(Continued)

(52) U.S. Cl.

CPC ..... *A63B 60/32* (2015.10); *A63B 21/0455* (2013.01); *A63B 21/16* (2013.01); *A63B 21/4035* (2015.10); *A63B 53/007* (2013.01); *A63B 53/14* (2013.01); *A63B 60/14* (2015.10); *A63B 60/20* (2015.10); *A63B 60/52* (2015.10); *A63B 69/3685* (2013.01); *A63B 23/03516* (2013.01); *A63B 23/1209* (2013.01); *A63B 60/08* (2015.10); *A63B 60/22* (2015.10); *A63B 60/50* (2015.10); *A63B 60/54* (2015.10); *A63B 2209/00* (2013.01); *A63B 2209/08* (2013.01)

(58) Field of Classification Search

CPC ..... A63B 9/3685; A63B 21/16; A63B 53/007; A63B 53/14; A63B 21/4035; A63B 60/52; A63B 60/32; A63B 60/20; A63B 60/14; A63B 21/0455; A63B 60/50; A63B 23/03516; A63B 23/1209; A63B 2209/00; A63B 2209/08; A63B 60/22; A63B 60/54; A63B 60/08; A63B 69/3685

See application file for complete search history.

(56) References Cited

U.S. PATENT DOCUMENTS

| | | | |
|---|---|---|---|
| 2,225,839 | A | 12/1940 | Moore, Jr. |
| 3,834,714 | A | 9/1974 | Smolinski |

(Continued)

FOREIGN PATENT DOCUMENTS

| | | |
|---|---|---|
| DE | 10202814 | 8/2003 |
| EP | 0 360 762 | 3/1990 |
| WO | 02/053233 | 7/2002 |

*Primary Examiner* — Stephen Blau

(74) *Attorney, Agent, or Firm* — Gudrun E. Huckett

(57) ABSTRACT

A golf club has a shaft having a shaft axis; a club head connected to a first end of the shaft; and a grip connected to a second end of the shaft opposite the club head. The grip is provided with a first grip part and a second grip part, wherein the first grip part is torsionally movable to a limited extent relative to the second grip part and relative to the shaft about the shaft axis.

3 Claims, 4 Drawing Sheets

(51) Int. Cl.
*A63B 60/08* (2015.01)
*A63B 60/50* (2015.01)

(56) References Cited

U.S. PATENT DOCUMENTS

| | | | | |
|---|---|---|---|---|
| 5,538,476 | A * | 7/1996 | Riverman | A63B 53/14 473/295 |
| 5,586,946 | A | 12/1996 | Haber et al. | |
| 5,730,661 | A * | 3/1998 | Kozub | A63B 53/14 473/294 |
| 5,782,705 | A * | 7/1998 | Solari | A63B 53/007 473/300 |
| 2001/0041626 | A1 | 11/2001 | Madelle et al. | |
| 2004/0128798 | A1 * | 7/2004 | Cacicedo | A63B 60/08 16/436 |
| 2006/0009304 | A1 | 1/2006 | Tremulis et al. | |
| 2008/0125238 | A1 | 5/2008 | Chen | |

* cited by examiner

GOLF CLUB

BACKGROUND OF THE INVENTION

The invention relates to a golf club comprising a grip, a shaft, and a club head.

Golfers experience the phenomenon of "yips". This is a sudden involuntary jerky muscle twitch that occurs particularly when putting. These muscle twitches occur shortly before the club head contacts the ball. This causes the ball to travel in a direction deviating from the intended direction. Since the muscle twitches cannot be influenced by the golfer, this phenomenon is a significant handicap for the golfer.

It is an object of the invention to configure a golf club of the aforementioned kind in such a way that such involuntary jerky muscle twitches have no disadvantageous effect on putting.

SUMMARY OF THE INVENTION

In accordance with the invention, this is achieved in that the grip comprises at least two grip parts wherein a first grip part is capable of twisting to a limited extent relative to the second grip part and relative to the shaft about the shaft axis of the shaft.

The golf club of the invention comprises a grip that comprises at least two grip parts. The first grip part which is gripped by the hand which is experiencing muscle twitches can twist relative to the second grip part and the shaft about the shaft axis. In this way, the involuntary muscle twitches of this hand have no effect on the precision of putting. The muscle twitches are absorbed or compensated by the corresponding limited twisting or torsional movement of the first grip part. The second grip part that is gripped by the hand which is not experiencing muscle twitches can reliably perform the putt. The golf club of the invention enables the golfer to achieve high precision putts despite the yips phenomenon.

In an advantageous embodiment, the two grip parts are connected to each other by at least one torsion damper. The second grip part is fixedly connected to the shaft while the first grip part can be torsionally moved to a limited extent. The torsion damper forms the connection between the first and second grip parts. The first and second grip parts each are fixedly connected to the torsion damper, for example, by an adhesive or by fusing (welding). The torsion damper enables torsion of the first grip part relative to the second grip part.

The torsion damper comprises preferably a torsion-soft area that is surrounded by a torsion-stiff jacket. The torsion-stiff jacket forms the exterior side of the torsion damper while the inner area of the torsion damper is provided with the torsion-soft area. The jacket protects the torsion-soft area.

In an advantageous embodiment, the torsion-soft area of the torsion damper is formed by webs that are positioned at a spacing relative to each other and extend away from the jacket inwardly. By means of the number of the webs and/or the width of the webs, the torsion stiffness can be precisely matched to the muscle twitches of the respective golfer.

The webs of the torsion damper connect in an advantageous way the torsion-stiff jacket with an inner ring. The inner ring is advantageously positioned coaxially to the outer jacket and enables arrangement of the torsion damper on the shaft.

The webs extend advantageously across the entire axial height of the torsion damper.

In an advantageous embodiment, the webs are separated from each other by hollow spaces or cavities which extend across the axial height of the torsion damper. The webs with the intermediately positioned hollow spaces or cavities form the torsion-soft area that enables torsion of the first grip part relative to the second grip part. By matching the size of the hollow spaces or cavities as well as the width of the webs and/or the number of the webs, the torsion stiffness can be adjusted in a simple way to any situation.

The first grip part that can be twisted to a limited extent is preferably arranged on the shaft by means of at least one slide bearing. In this way, the first grip part can be twisted or rotated in a simple way to a limited extent relative to the shaft.

In another advantageous embodiment, the two grip parts together are formed as one piece. In this context, the first grip part is comprised at least partially of torsion-soft material so that the first grip part can twist to a limited extent in order to absorb or compensate the muscle twitches in the afflicted hand of the golfer.

In an advantageous embodiment, the first grip part with the torsion-soft material comprises webs wherein the webs connect a hard outer shell with an inner sleeve. By means of the width of the webs and/or the number of the webs, the torsion stiffness can be adjusted in a simple way and matched to the needs of the golfer.

The webs are advantageously separated from each other by hollow spaces or cavities so that in a simple way, by suitable selection of the size of the hollow spaces or cavities and the number of the webs and/or the width of the webs, the desired torsion stiffness of the torsion-soft material can be adjusted.

In an advantageous embodiment, the two grip parts together are formed as one piece. The torsion damper is formed by a torsion-soft area between the two grip parts. By means of this torsion-soft area, the first grip part can perform, to a limited extent, a torsional movement (can twist or turn) relative to the second grip part as well as relative to the shaft.

Advantageously, a grip sleeve that is comprised of elastic material is employed as a grip. The grip sleeve is an inexpensive component that, furthermore, can be mounted easily on the shaft of the golf club.

The torsion-soft area can be easily generated in that the grip is formed with a weakened material section that forms the torsion-soft area.

In an advantageous embodiment, the second grip part of the grip sleeve is fastened fixedly on the shaft while the first grip part is arranged on the shaft so as to be turnable to a limited extent. When due to involuntary muscle twitches of the golfer this first grip part is rotated to a limited extent about the shaft axis of the shaft, the jacket section of the grip sleeve which is positioned between the two grip parts is elastically twisted. This jacket section is arranged such that it is not directly connected to the shaft of the golf club. The jacket section therefore can perform a yielding movement by means of elastic torsion. As a result of the elasticity, the first grip part is then returned into its initial position as soon as the muscle twitches stop.

In an advantageous embodiment, the bottom grip part is seated with a hard bearing layer on the shaft. The hard bearing layer enables in a simple way that the bottom grip part can be turned to a limited extent relative to the shaft in order to compensate the involuntary sudden muscle twitches of the golfer.

In an advantageous embodiment, the bearing layer is embodied by a sleeve which is attached to the bottom grip part. The sleeve can be made of metal or can be comprised of a hard plastic material.

In another advantageous embodiment, at least the bottom grip part is comprised of a material which, for forming the bearing layer, is harder than the surrounding or remaining area of the bottom grip part. Such a material is e.g. a suitable plastic material with which at least the bottom grip part of the grip can be manufactured such that it is hard in the contact area on the shaft but is soft in the remaining area of the bottom grip part. Then the hard plastic layer ensures the limited rotational movement of the bottom grip part relative to the shaft while the outer softer plastic part contributes to good gripping action of the bottom grip part.

The subject matter of the invention is not only defined by the subject matter of the individual claims but also by all features and properties which are disclosed in the drawings and the description. Inasmuch as these features and properties are novel relative to the prior art, they considered to be relevant to the invention individually or in combination, even if they are not the subject matter of the claims.

Further features of the invention result from the further claims, the description, and the drawings.

BRIEF DESCRIPTION OF THE DRAWING

The invention will be explained in more detail with the aid of the embodiments illustrated in the drawings.

DESCRIPTION OF PREFERRED EMBODIMENTS

Figure 1:
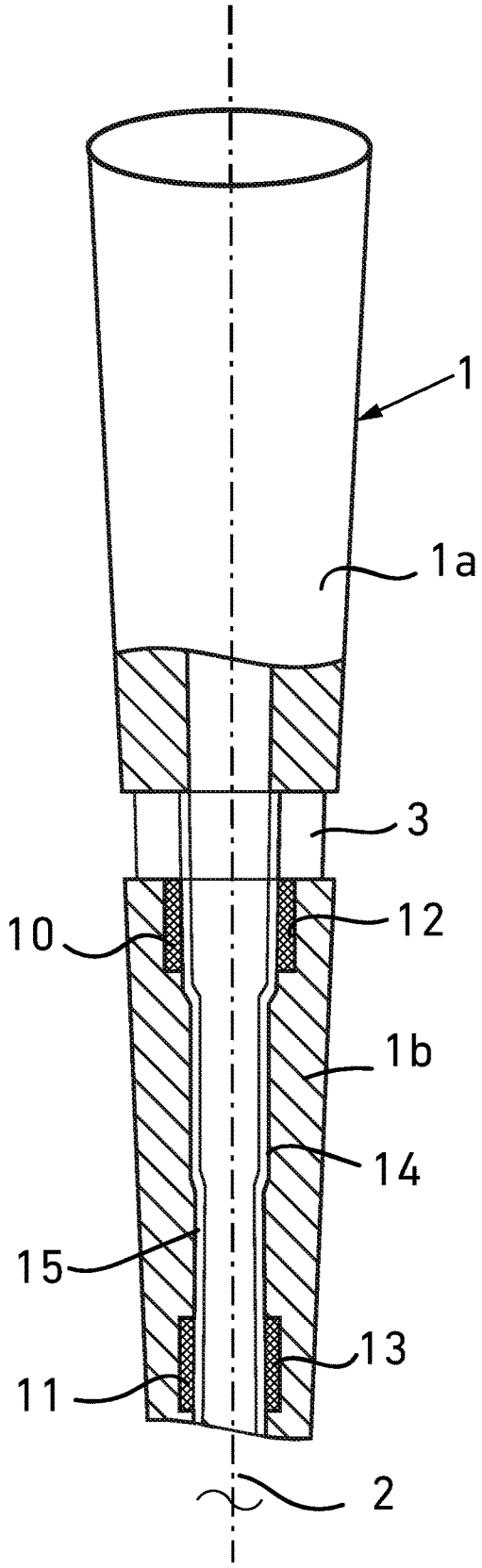
FIG. 1 shows partially in section and partially in a side view a part of the golf club according to the invention.

The golf club has at the upper end a grip 1 and at the lower end a club head H (only schematically indicated in FIG. 1). The connection of the club head H with the grip 1 is realized by a shaft 2 which is usually made of steel or of a carbon-fiber reinforced plastic material. The grip 1 comprises a first grip part (bottom grip part 1*b*) and a second grip part (top grip part 1*a*). The two grip parts 1*a*, 1*b* are designed such that the first grip part, i.e., the bottom grip part 1*b*, can perform limited torsional movements relative to the shaft 2 and relative to the second grip part, i.e., the top grip part 1*a*. The bottom grip part 1*b* can be rotated, for example, about an angle of +/−5° about the shaft axis of the shaft 2.

The top grip part 1*a* is fixedly connected to the shaft 2, for example, is adhesively connected thereto or in other ways fixedly (i.e., no rotation between top grip part and shaft is possible) connected thereto.

Figure 2:
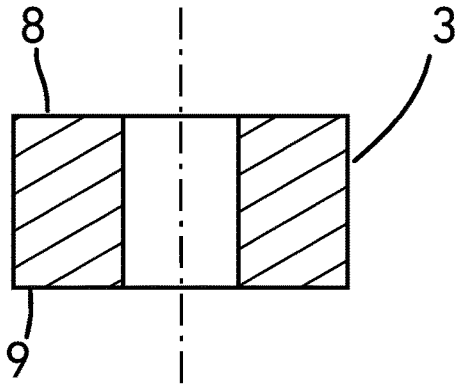
FIG. 2 shows a section, taken along the section line II-II of FIG. 3, of the torsion damper of the golf club according to the invention.
Figure 3:
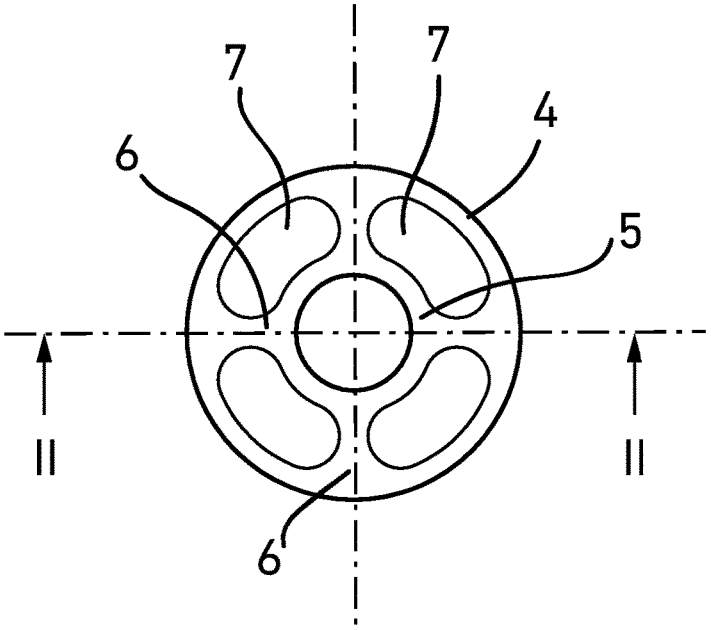
FIG. 3 is a plan view of the torsion damper according to FIG. 2.

The bottom grip part 1*b* is separated by a torsion damper 3 from the top grip part 1*a*. The torsion damper 3 (FIGS. 2 and 3) comprises an outer ring 4 and an inner ring 5. The inner ring 5 of the torsion damper 3 surrounds the shaft 2 with play (FIG. 1). Both rings 4, 5 are connected to each other by webs 6. In the embodiment, the two rings 4, 5 are of a circular design and are arranged coaxially relative to each other. Between the webs 6 and the rings 4, 5, hollow spaces or cavities 7 are formed which are axially penetrating the torsion damper 3.

The torsion damper 3 is configured such that it comprises a flat topside 8 and a flat bottom side 9. The bottom grip part 1*b* is resting with flat surface contact on the flat bottom side 9 and is connected with the torsion damper 3 by an adhesive or by plastic fusing (welding). The top grip part 1*a* is fixedly connected to the flat top side 8 of the torsion damper 3 also by an adhesive or by plastic fusion (welding). In the embodiment, the torsion damper 3 has a smaller outer diameter compared to the two grip parts 1*a*, 1*b*. Of course, the torsion damper 3 can also have the same outer diameter as the grip parts 1*a*, 1*b*.

In order for the bottom grip part 1*b* to be able to perform limited torsional movements about the shaft axis of the shaft 2, the bottom grip part 1*b* is seated with at least one slide bearing 10 on the shaft 2. In the embodiment, two slide bearings 10, 11 are provided that are positioned at an axial spacing one behind the other and support the bottom grip part 1*b* on the shaft 2 so that the bottom grip part 1*b* is rotatable to a limited extent on the shaft 2. The two slide bearings 10, 11 each are positioned in an annular recess 12, 13. The annular recesses 12, 13 are arranged in the inner wall 14 of the through bore 15 of the bottom grip part 1*b*. The recess 12 is open in the direction toward the torsion damper 3. The slide bearings 10, 11 ensure that the bottom grip part 1*b* is supported on the shaft 2 free of torsion forces. The slide bearings 10, 11 can be formed by a suitable plastic material that can be connected with the shaft 2 and permits a limited torsion of the bottom grip part 1*b*.

With the exception of a connection provided by the slide bearings 10, 11, the bottom grip part 1*b* is not connected to the shaft 2, i.e., the shaft 2 penetrates the central through bore 15 with play.

The two grip parts 1*a*, 1*b* can be comprised of a material that is suitable for such golf club grips.

When putting on the green, golfers experience that the hand that during putting determines the length of the putt suddenly involuntarily twitches shortly before the golf club contacts the golf ball. This causes the golf ball to move in a direction different from the intended direction. These involuntary jerky muscle twitches, known as yips, occur usually only in the hand with which the length of the putt is determined. In case of a right-handed person, this is the right hand. The lead hand which determines the direction of the golf does not experience such muscle twitches. A right-handed person grips during putting with his or her left hand the top grip part 1*a* which is fixedly connected to the shaft 2. The right hand grips the bottom grip part 1*b*. Since the bottom grip part 1*b* can be twisted to a limited extent about the shaft axis of the shaft 2, muscle twitches of the right hand have no effect on the putting direction. The muscle twitches are compensated by the bottom grip part 1*b* in that the grip part 1*b* is caused to move torsionally about the shaft axis of the shaft 2 in accordance with the muscle twitches. Since the bottom grip part 1*b* is supported by means of the slide bearings 10, 11 on the shaft 2, the muscle twitches have no effect on the putting direction which is determined by the left hand of the golfer. Therefore, the golfer can precisely putt the golf ball in the direction of the hole.

In case of a left-handed person, the left hand grips the bottom grip part 1*b* while the right hand grips the top grip part 1*a*.

The torsion damper 3 is designed such that the damping action can be adjusted depending on the strength and effect of the muscle twitches. The torsion damper 3 is comprised, for example, of a rubber mixture. By selecting the degree of hardness of the rubber mixture, the degree of the damping action can be adjusted. The damping action is also determined by the number of connecting webs 6 and/or the width of the connecting webs 6 and/or the height of the torsion damper 3. Accordingly, by suitable selection of the rubber mixture and/or the number of the connecting webs 6 and/or the width of the connecting webs 6 and/or the height of the torsion damper 3, the golf club can be optimally adjusted to the muscle twitches of the respective golfer. For the adaptation process, first a torsion damper 3 is employed that advantageously is connected by means of film magnets with the top and bottom grip parts 1*a*, 1*b*. Accordingly, in a very simple way a suitable torsion damper 3 can be determined. As soon as the proper torsion damper 3 has been determined, the corresponding torsion damper 3 is connected fixedly to the two grip parts 1*a*, 1*b*. In this way, the optimal damping action on the golf club grip 1 can be determined in a very simple way.

Figure 4:
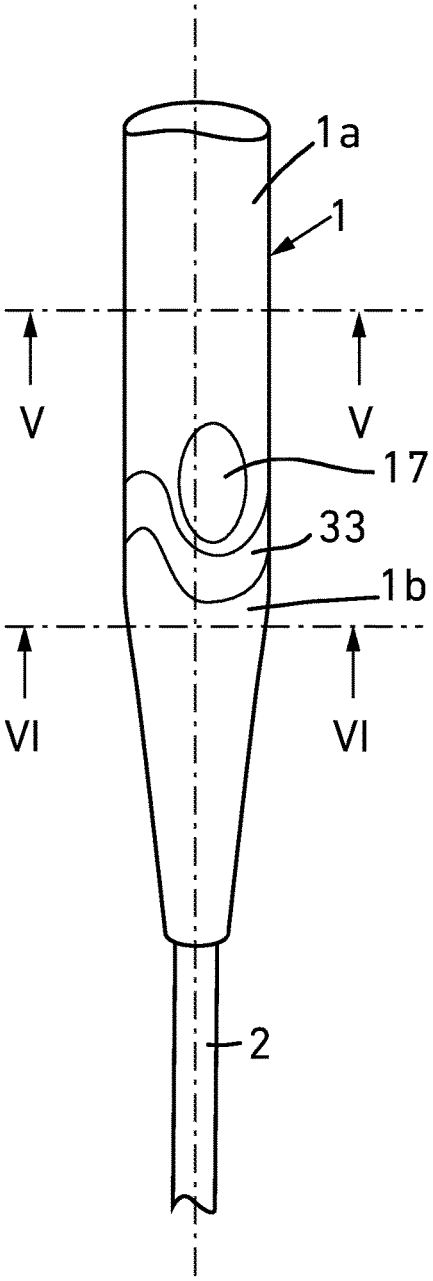
FIG. 4 in an elevation view a portion of a golf club according to the invention in a further embodiment.
Figure 5:
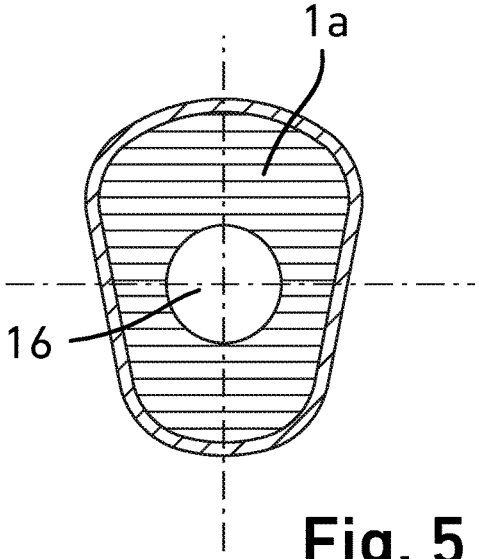
FIG. 5 is a section along the line V-V of FIG. 4.
Figure 6:
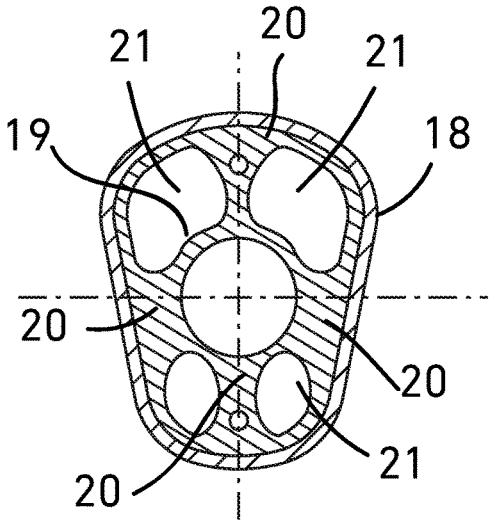
FIG. 6 shows a section along the line VI-VI of FIG. 4.

FIGS. 4 to 6 show a further embodiment of a golf club. In accordance with the preceding embodiment, the grip 1 is comprised of top grip part 1*a* and bottom grip part 1*b*. The top grip part 1*a* is seated fixedly on the shaft 2; the shaft 2 also penetrates the bottom grip part 1*b* axially. The top grip part 1*a* is designed like a conventional golf club grip and has, for example, a non-round contour (FIG. 5). Centrally, the top grip part 1*a* has an axial through bore 16 into which the shaft 2 projects. The top grip part 1*a* is connected in a suitable way fixedly to the shaft 2.

The top grip part 1*a* is provided at its bottom side with a thumb support 17. The bottom grip part 1*b* has a stable outer shell 18 (FIG. 6) that surrounds an inner sleeve 19 that is comprised of a hard material, preferably of polyethylene or polyamide. The inner sleeve 19 is connected by webs 20 with the outer shell 18. The webs 20 are separated from each other by interstices 21. The webs 20 are comprised of soft plastic material such as appropriate elastomers, rubber or caoutchouc compounds. It is fixedly connected to the outer side of the inner sleeve 19 as well as to the inner side of the outer shell 18. The shape-stable inner sleeve 19 is seated fixedly on the shaft 2. The webs 20 which are comprised of soft plastic material enable a limited torsion of the bottom grip part 1*b* about the shaft axis of the shaft 2. The torsion angle range can be, for example, approximately +/−5°. The width of the webs 20 and/or the number of the webs 20 influence in connection with the selection of the soft plastic material the torsion stiffness of the bottom grip part 1*b*.

The two grip parts 1*a*, 1*b* can be separate components which are fastened in the described way on the shaft 2. In deviation from the illustrated and described embodiment, the two grip parts 1*a*, 1*b* together can also be formed as one piece. The transition area 33 between the two grip parts 1*a*, 1*b* comprises in this case a reduced wall thickness (weakened material section) in comparison to the two grip parts 1*a*, 1*b*. In order for the bottom grip part 1*b* to be able to twist optimally relative to the shaft 2 to a limited extent, the transition area 33 is preferably of a wave-shaped configuration about the circumference of the grip 1.

As a result of the limited torsion possibility of the bottom grip part 1*b*, it is ensured also for this golf club that involuntary muscle twitches of the golfer have no effect on the precision of the putting direction during putting.

Figure 7:
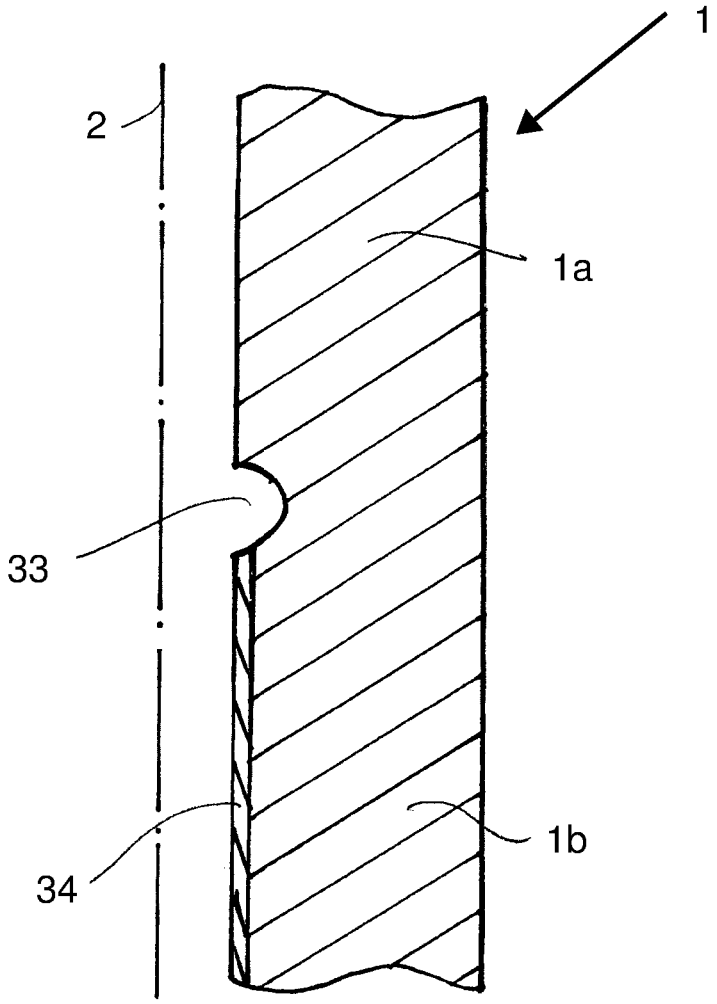
FIG. 7 shows in section a portion of a further embodiment of the golf club according to the invention.

FIG. 7 shows an embodiment in which the grip 1 is embodied as one piece, i.e., is monolithic. The grip 1 is formed by a grip sleeve comprised of plastic material and fastened on the shaft 2 (illustrated schematically by the shaft axis). The portion of the grip sleeve which forms the top grip part 1*a* is fixedly connected to the shaft 2, for example, is adhesively connected thereto. The part of the grip sleeve which forms the bottom grip part 1*b* is arranged so as to be turnable to a limited extent on the shaft 2. This can be achieved, for example, in that this grip sleeve area (1*b*) is fastened on a support sleeve 34, provided as a bearing layer, which is supported so as to be turnable to a limited extent on the shaft 2.

The grip sleeve forming the grip 1 is comprised of elastic plastic material and the transition area 33 between the two grip parts 1*a*, 1*b* is formed by a jacket section of the grip sleeve forming the grip 1 that has a reduced thickness (weakened material section). When thus the grip part 1*b* as a result of the twitch movements of the lead hand of the golfer is rotated relative to the shaft 2 to a minimal extent, the transition area 33 is elastically deformed accordingly by a torsional movement. Accordingly, the muscle twitch has no effect on the putting direction. The transition area 33 forms the torsion-soft area with which the involuntary torsional movements of the lead hand are compensated in that the transition area 33, in accordance with the amount of the torsional movements, is elastically deformed so that the muscle twitches are compensated in this way. Since the transition area 33 has a reduced wall thickness, i.e., a weakened material section, the bottom grip part 1*b* can be rotated to a limited extent by elastic torsion relative to the shaft 2 and relative to the top grip part 1*a*. As in the preceding embodiments, the torsion angle range can be, for example, approximately +/−5° (relative to the neutral—no load—position.

The support sleeve 34 (bearing layer) is comprised of a hard material, for example, of metal or a hard plastic material. The grip sleeve forming the grip 1, or its bottom grip part 1*b*, is fixedly connected in a suitable way with the support sleeve 34. The inner diameter of the support sleeve 34 (hard bearing layer) corresponds advantageously to the inner diameter of the top grip part 1*a*.

Instead of providing the support sleeve 34, it is also possible to produce the bottom grip part 1*b* of two materials of different hardness. The area of the bottom grip part 1*b* which is contacting the shaft 2 is comprised of a correspondingly hard material, preferably of a correspondingly hard plastic material. This hard area can be configured to be thin because it is only provided to enable the bottom grip part 1*b* to carry out a limited turning movement about the shaft axis of the shaft 2. The remaining part of the bottom grip part 1*b* can be comprised of a gripping-friendly softer material, in particular a softer plastic material.

The grip sleeves forming the grips 1 are components that are commercially available and are comprised of a multi-compound composite. These grip sleeves can be purchased inexpensively and, when they are attached in the described way on the shaft 2 of the golf club, can compensate excellently the involuntary muscle twitches of the golfer without impairing the putting precision.

In the described embodiments, the bottom grip part 1*b* always returns into its initial (neutral) position as soon as the involuntary muscle twitches stop.

The specification incorporates by reference the entire disclosure of German priority document 10 2015 006 155.0 having a filing date of May 8, 2015.

While specific embodiments of the invention have been shown and described in detail to illustrate the inventive principles, it will be understood that the invention may be embodied otherwise without departing from such principles.

What is claimed is:

1. A golf club comprising:

a shaft having a shaft axis;

a club head connected to a first end of the shaft;

a grip connected to a second end of the shaft opposite the club head;

the grip comprising a first grip part and a second grip part, wherein the first grip part is torsionally movable to a limited extent relative to the second grip part and relative to the shaft about the shaft axis;

a torsion damper provided between the first grip part and the second grip part, wherein the first grip part, the torsion damper, and the second grip part together are formed as one piece, and wherein the torsion damper is formed by a torsion-soft area disposed between the first grip part and the second grip part;

a hard bearing layer, wherein the first grip part is seated with the hard bearing layer on the shaft.

2. The golf club according to claim 1, wherein the hard bearing layer is a support sleeve which is fastened to the first grip part.

3. The golf club according to claim 1, wherein at least the first grip part is comprised of a material that, for formation of the hard bearing layer, is harder than the a surrounding area of the first grip part that surrounds the hard bearing layer.

* * * * *